US008250674B2

(12) United States Patent
Higgins et al.

(10) Patent No.: US 8,250,674 B2
(45) Date of Patent: Aug. 28, 2012

(54) MUSICAL HEADWEAR

(76) Inventors: Gregory L. Higgins, Port Charlotte, FL (US); Bob J. Higgins, Punta Gorda, FL (US)

( * ) Notice: Subject to any disclaimer, the term of this patent is extended or adjusted under 35 U.S.C. 154(b) by 0 days.

(21) Appl. No.: 12/847,903

(22) Filed: Jul. 30, 2010

(65) Prior Publication Data

US 2011/0252540 A1 Oct. 20, 2011

Related U.S. Application Data

(60) Provisional application No. 61/324,916, filed on Apr. 16, 2010.

(51) Int. Cl.
*A42B 1/24* (2006.01)

(52) U.S. Cl. ..... 2/209.13

(58) Field of Classification Search ..... 2/422, 906, 2/209.13, 175.1, 195.2, 171
See application file for complete search history.

(56) References Cited

U.S. PATENT DOCUMENTS

| | | | | |
|---|---|---|---|---|
| 4,525,878 | A * | 7/1985 | Lowe, Jr. | 2/209.13 |
| 4,858,248 | A | 8/1989 | Goldsmith et al. | |
| 4,875,238 | A | 10/1989 | Solomon et al. | |
| D321,581 | S * | 11/1991 | Li | D2/866 |
| 5,167,559 | A * | 12/1992 | Power-Fardy | 446/27 |
| 5,410,746 | A * | 4/1995 | Gelber | 455/344 |
| 5,438,698 | A * | 8/1995 | Burton et al. | 455/351 |
| 5,462,471 | A * | 10/1995 | Power-Fardy | 446/26 |
| 5,510,961 | A * | 4/1996 | Peng | 362/106 |
| D370,334 | S | 6/1996 | Stevenson et al. | |
| 5,724,678 | A | 3/1998 | McCallum et al. | |
| 5,784,733 | A * | 7/1998 | Rasamny et al. | 5/482 |
| 7,044,615 | B2 * | 5/2006 | Gesten | 362/106 |
| 2003/0196249 | A1 * | 10/2003 | Roberts | 2/209.13 |
| 2006/0182270 | A1 | 8/2006 | Burns | |
| 2006/0185062 | A1 * | 8/2006 | Peng et al. | 2/209.13 |
| 2007/0226876 | A1 * | 10/2007 | Foust et al. | 2/171 |
| 2008/0144872 | A1 | 6/2008 | Phillips | |
| 2008/0263750 | A1 | 10/2008 | Chen et al. | |

(Continued)

OTHER PUBLICATIONS

History of Computer Memory by Mary Bellis, About.com Guide (http://inventors.about.com/od/rstartinventions/a/Ram.htm). (pp. 1-2) printed Jan. 3, 2012.

(Continued)

*Primary Examiner* — Danny Worrell
(74) *Attorney, Agent, or Firm* — Miller Canfield Paddock and Stone PLC; John H. Engelmann

(57) ABSTRACT

The musical headwear includes headwear having a pocket that carries an electronic audio device. The pocket has an opening, sealable via fasteners disposed across fabric surrounding the top central portion of the opening. The electronic audio device is dropped into the open pocket and then sealed inside by fastening together the fasteners proximate the top central portion of the pocket opening. Gaps on either side of the seal are provided so that a user can touch the case of the electronic audio device, the case having a touch sensitive electronic pad that actuates the unit when momentarily touched by the user. When the unit is actuated, speakers embedded in the audio unit broadcast a song, chant, or other refrain that has been pre-stored in the unit's digital memory. The unit is factory programmed to play one or more different programs responsive to momentary user contact with the touch pad.

5 Claims, 6 Drawing Sheets

U.S. PATENT DOCUMENTS

| | | | | |
|---|---|---|---|---|
| 2008/0295224 | A1* | 12/2008 | Mintzer | 2/209.13 |
| 2008/0298608 | A1 | 12/2008 | Wilcox | |
| 2008/0304682 | A1 | 12/2008 | Seade | |
| 2009/0175482 | A1 | 7/2009 | Crutcher | |
| 2009/0193565 | A1 | 8/2009 | Wilens | |
| 2009/0210995 | A1 | 8/2009 | Kwon et al. | |
| 2010/0031424 | A1* | 2/2010 | Sharpe et al. | 2/209.11 |

OTHER PUBLICATIONS

Antique Radio Classified—With teh Collectors menta, Web Edition—Collecting MP3 Portables Part 1, by Richard Menta (http://www.antiqueradio.com/Dec04_Menta_mp3pt.1html). (pp. 1-8) printed Jan. 3, 2012.

* cited by examiner

MUSICAL HEADWEAR

CROSS-REFERENCE TO RELATED APPLICATION

This application claims the benefit of U.S. Provisional Patent Application Ser. No. 61/324,916, filed Apr. 16, 2010.

BACKGROUND OF THE INVENTION

1. Field of the Invention

The present invention relates to hats and to electronic devices for playback of audio, and particularly to musical headwear that plays back audio when the headwear is touched.

2. Description of the Related Art

While numerous hats with MP3 player speakers designed to fit over a user's ears have reached the marketplace, such headwear only allows the wearer to listen to the audio. There are times and/or venues, however, when a wearer may want to have others listen to the audio. One such venue is a sporting event. Sporting events are occasions where team support is shown in various ways, such as wearing team colors and/or logos, dressing in a certain way, painting bodies or body parts, and the like. The playing of a team fight song, chant, or other "team" song could demonstrate a way of showing team support. However, it is impractical to carry most audio systems to the sporting arena, field or place of play. Therefore, it would be desirable to have a wearable portable audio playback unit thereby eliminating the requirement of carrying such a system.

Thus, musical headwear solving the aforementioned problems is desired.

SUMMARY OF THE INVENTION

The musical headwear includes any type of headwear having a pocket/pouch that carries an electronic audio playback system. The pouch has an opening, which is sealable using fasteners disposed across fabric surrounding the top central portion of the opening. The electronic audio playback system is dropped into the open pouch and then sealed inside by fastening together the fasteners proximate the top central portion of the pouch opening. Gaps on either side of the seal are provided so that a user can touch the case of the electronic audio system, the case having a touch sensitive electronic pad that actuates the unit when momentarily touched by the user. When the unit is actuated, speakers embedded in the audio unit broadcast a song, chant, or other refrain that has been pre-stored in the unit's digital memory. The unit is factory programmed to play one or more, e.g., four different programs responsive to momentary user contact with the touch pad.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
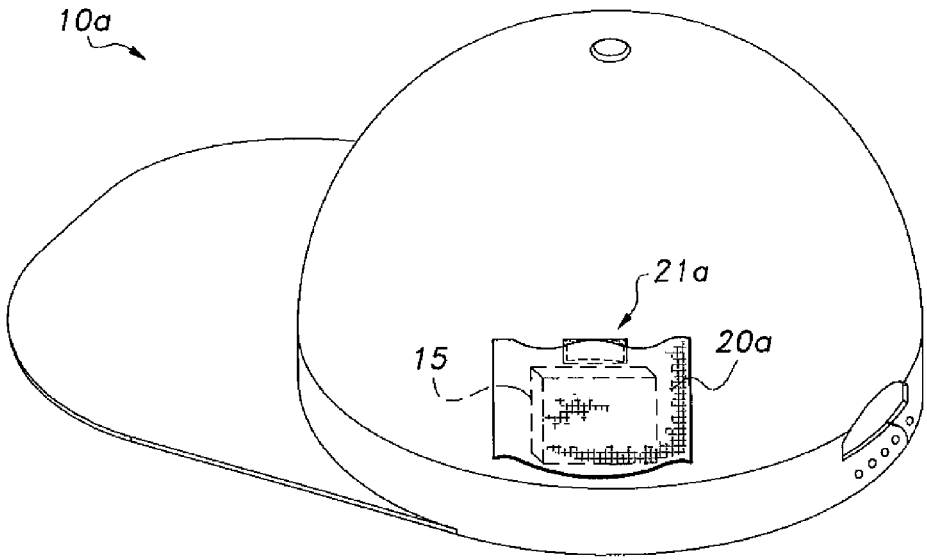
FIG. 1 is a perspective view of musical headwear according to the present invention, shown embodied in a cap having a retaining pouch on the side of the cap.
Figure 2:
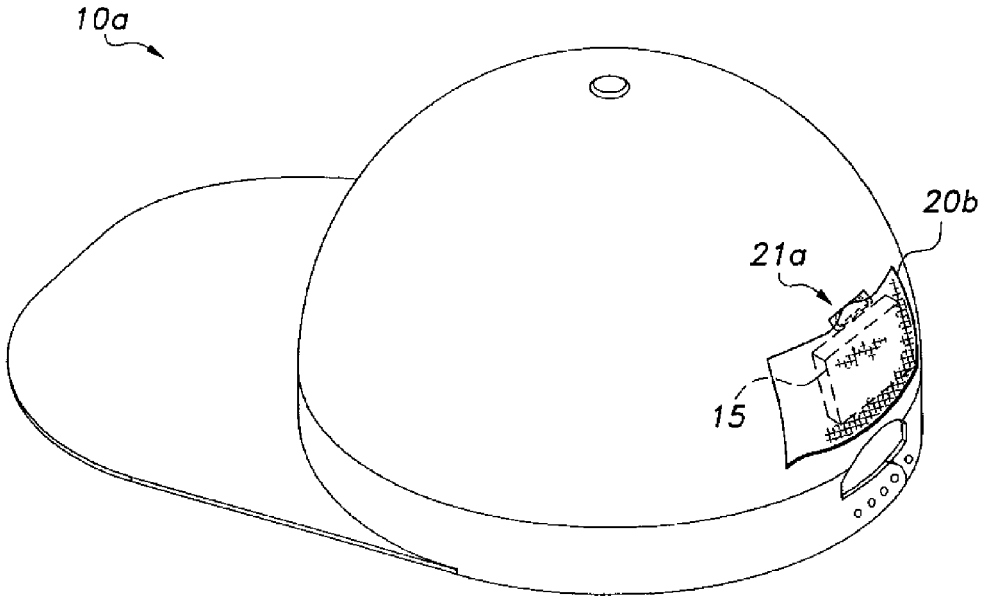
FIG. 2 is a perspective view of musical headwear according to the present invention, showing alternative placement of the retaining pouch on the back of the cap.
Figure 3:
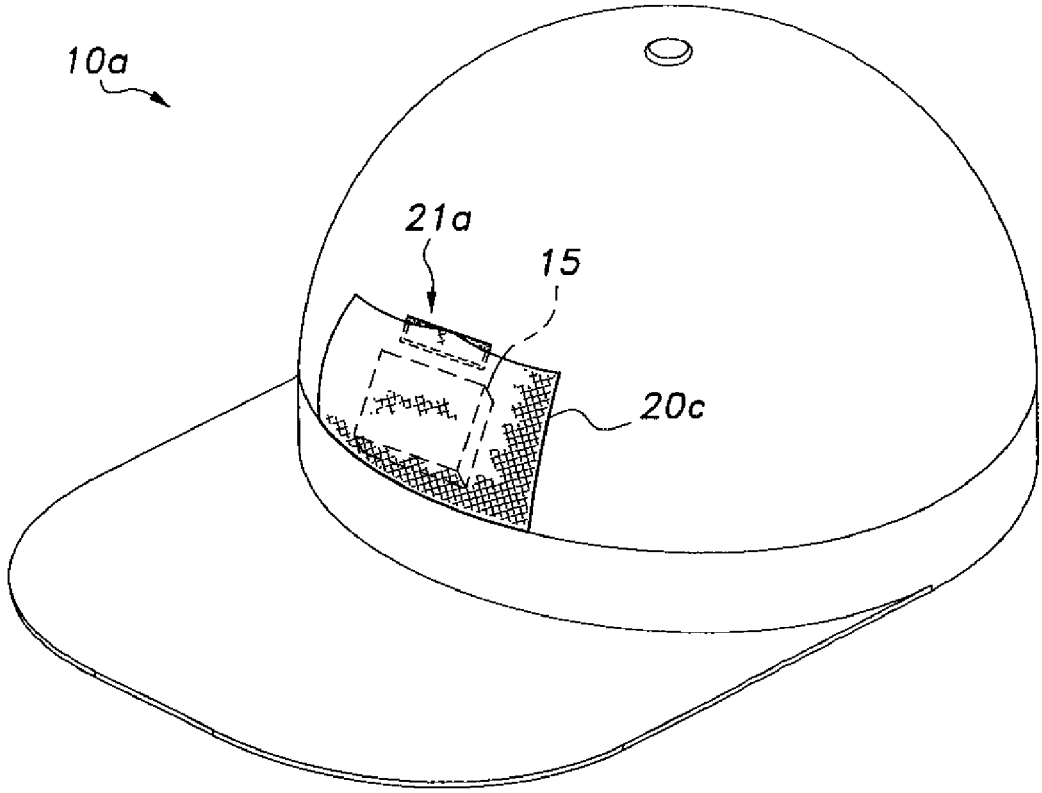
FIG. 3 is a perspective view of musical headwear according to the present invention, showing alternative placement of the retaining pouch on the front of the cap.
Figure 6:
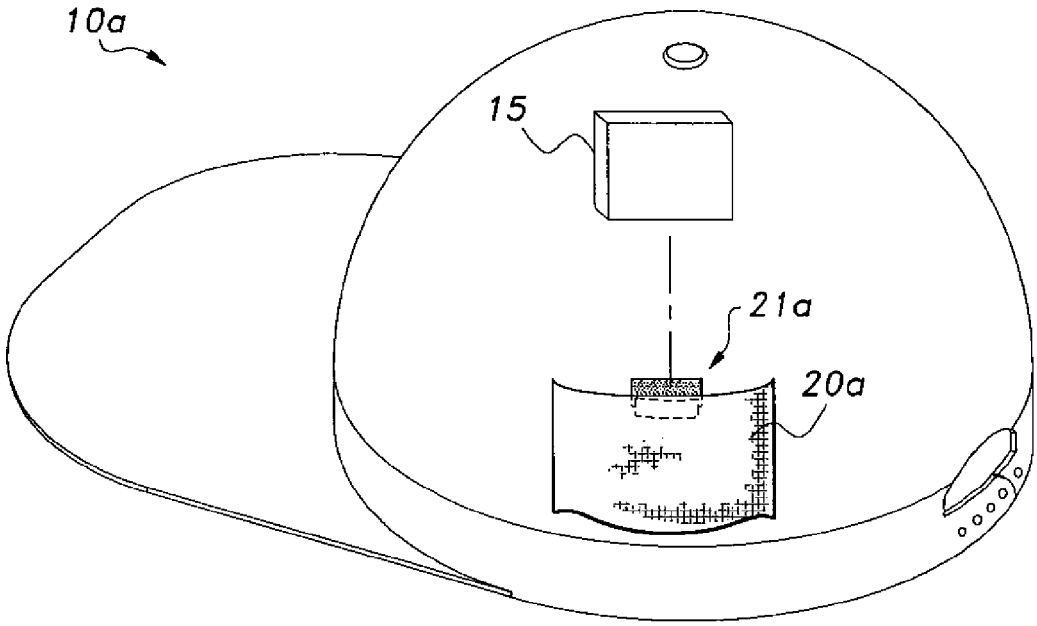
FIG. 6 is a partially exploded, perspective view of the musical headwear of FIG. 1, showing the audio player removed from the retaining pouch.

The musical headwear includes any type of headwear, e.g., a cap 10*a* (shown in FIGS. 1-3 and 6) or other hat or headwear, that has a pocket, e.g., the temple pocket 20*a* of FIGS. 1 and 6, capable of carrying an electronic audio playback device 15. As shown in FIGS. 1 and 6, the pouch 20*a* has an opening, which is sealable using hook and loop fasteners 21*a* disposed across the pouch fabric and the crown portion of the hat surrounding the top central portion of the opening. The preferably water resistant, electronic audio playback device 15 can be dropped into the open pouch 20*a* and then sealed inside via hook and loop fasteners 21*a* by pressing together the pouch and hat fabric proximate the top central portion of the pouch opening. The pouch 20*a* is formed from a rectangular patch of fabric having bottom and lateral edges sewn onto the temple portion of the cap 10*a*, thereby leaving an opening at the top. As shown in FIG. 2, a rear pouch 20*b* may be disposed on the rear portion of the cap 10*a*, or, as shown in FIG. 3, a front pouch 20*c* may be disposed on a front portion of the cap 10*a*. The pouches shown in FIGS. 2 and 3 are formed from fabric sewn onto the visor cap 10*a* in a similar manner as the temple pouch 20*a*.

Figure 7:
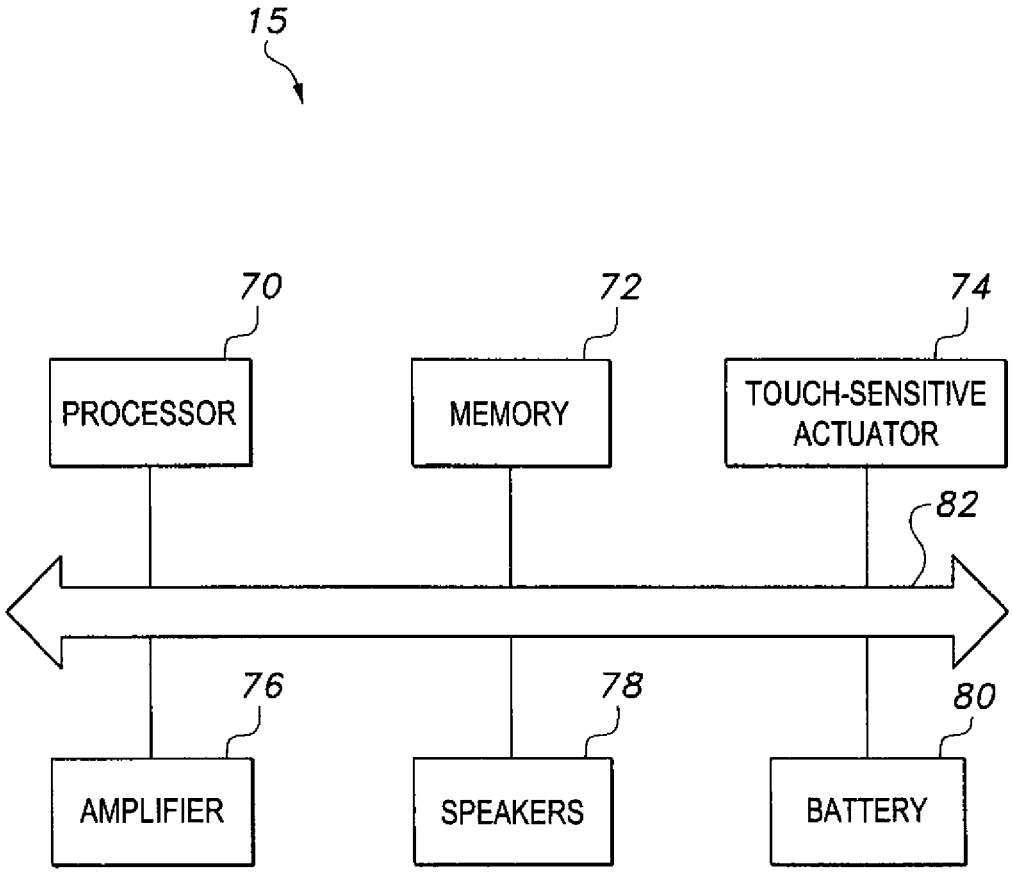
FIG. 7 is a block diagram of the electronic audio playback unit of musical headwear according to the present invention.

Gaps on either side of the pouch seal are provided so the a user can touch the case of the electronic audio playback device 15, the case having a touch sensitive electronic pad (or plate) 74, as seen in FIG. 7, that actuates the unit when momentarily touched by the user. When the unit is actuated, speakers 78 embedded in the device 15 broadcast a song, chant, or other refrain that has been pre-stored in the unit's digital memory 72. The unit 15 is factory programmed to play one or more different programs responsive to momentary user contact with the touch sensitive actuator 74.

As most clearly shown in FIG. 7, the audio playback device 15 includes a suitable power source, such as a battery 80; a programmed electronic chip 70; song memory 72; a touch sensitive actuator 74; and an amplifier 76, which delivers the programmed audio to speakers 78. The components are interconnected by a data and power bus 82.

Figure 4:
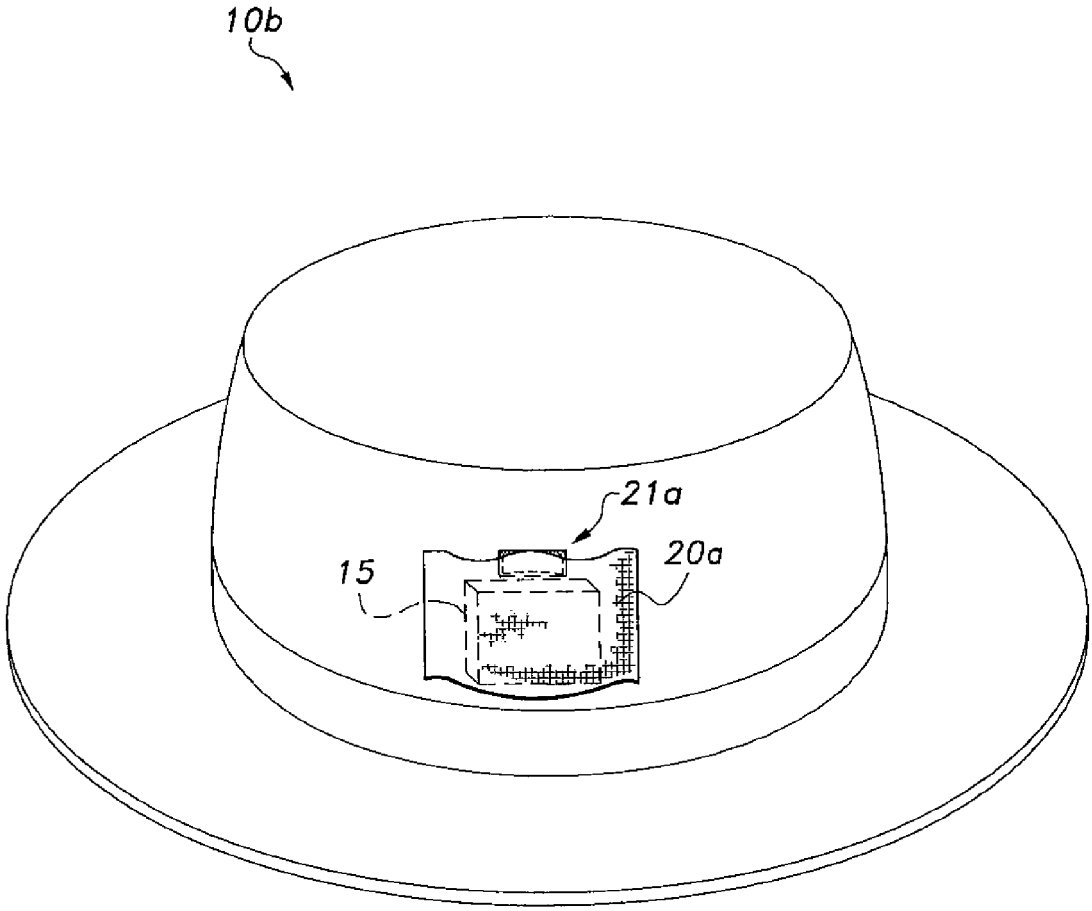
FIG. 4 is a perspective view of musical headwear according to the present invention, shown embodied in a different form of hat.
Figure 5:
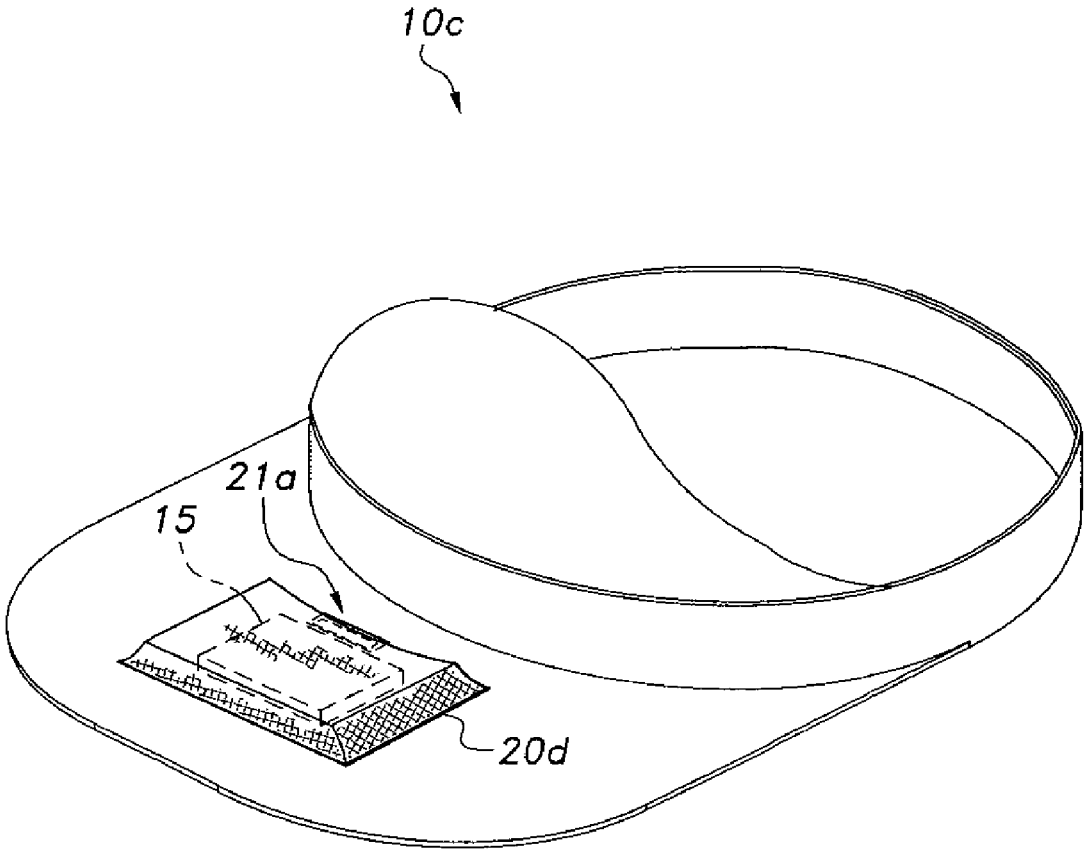
FIG. 5 is a perspective view of musical headwear according to the present invention, shown embodied in a visor.

Exemplary caps, such as, cap 10*a*, hat 10*b* (shown in FIG. 4), or visor 10*c* (shown in FIG. 5) can be made to order for a specific musical jingle, school fight song, or other custom sound as desired by the customer. Each sound is activated by touching the device 15. The device 15 may have a timer or be limited by time duration of the recorded sound so that the sound plays for a predetermined time duration and then remains silent until the device 15 is touched again, whereupon the device 15 may have been programmed to repeat the initial sound or to advance to a subsequent sound stored in memory 72.

The sounds stored in the memory 72 may include songs, jingles, talk, commentary, or the like tailored to a particular team, player, association, fraternity, or event. Preferably the programmed sound is associated with indicia or insignia that may be disposed on the musical headwear.

As shown in FIGS. 1-5, the musical headwear may be a cap 10*a*, a generic hat 10*b* of any style having a full brim, or a visor 10*c*. Moreover it is contemplated that any headwear, e.g., earmuffs, may have a pouch that adapts headwear for use as musical headwear.

The touch sensitive actuator 74 sends a signal to actuate a processor 70 responsive to a user's touch, and preferably has no moving parts, such as switch contact arms, which could get worn out. Such an actuator may use a sensor that detects a property of the user's finger(s), such as temperature, electrical resistance, capacitance, etc., and generates a voltage pulse or other signal that triggers the processor 70 to playback the audio recorded in memory 72. Such sensor devices and circuits are well known in the art, and need not be described further. It is not necessary for the user to maintain contact with the device 15, because it begins to play the stored sound upon activation and continues to play as programmed.

It is to be understood that the present invention is not limited to the embodiment described above, but encompasses any and all embodiments within the scope of the following claims.

We claim:

1. Musical headwear, comprising:

an article of headwear adapted for wearing on a user's head;

a fabric pouch having an opening, the pouch being attached to the headwear about its bottom and lateral edges thereby defining the opening;

fasteners disposed on the pouch proximate the opening and on the headwear, the fasteners reversibly closing at least a portion of the pouch opening to the headwear;

an electronic audio playback device including at least one loudspeaker, wherein the electronic audio playback device is water resistant, the electronic audio playback device being removably inserted into the pouch and secured in the pouch when the fasteners are arranged to close the portion of the pouch opening;

digital memory disposed in the playback device, the digital memory storing at least one sound audibly playable to listeners in the vicinity of the playback device upon actuation;

a touch sensitive actuator having no moving parts operably connected to the electronic audio playback device, the touch sensitive actuator actuating the electronic audio playback device when touched by the user; and indicia disposed on said headwear, at least one audible playable sound being associated with the indicia;

wherein when the user touches the actuator, the electronic audio playback device audibly plays the at least one stored sound through the at least one loudspeaker to listeners in the vicinity of the electronic audio playback device.

2. The musical headwear according to claim 1, wherein the at least one sound stored in said digital memory comprises a plurality of sounds, successive touching of said touch sensitive actuator causing said electronic audio playback device to play a different one of the plurality of sounds.

3. The musical headwear according to claim 1, wherein said at least one audibly playable sound is selected from the group consisting of songs, slogans, tunes, or chants.

4. The musical headwear according to claim 1, wherein said article of headwear is selected from the group consisting of hats, caps, visors, earmuffs, and headbands.

5. The musical headwear according to claim 1, further comprising means for playing said at least one stored sound for a predetermined time duration.

* * * * *